US007175445B2

(12) United States Patent
Consoli et al.

(10) Patent No.: US 7,175,445 B2
(45) Date of Patent: Feb. 13, 2007

(54) ELECTRICAL CONNECTOR POWER WAFERS

(75) Inventors: John Joseph Consoli, Harrisburg, PA (US); Brent Ryan Rothermel, Harrisburg, PA (US); James Lee Fedder, Etters, PA (US); George Richard Defibaugh, Harrisburg, PA (US); Henry Otto Herman, Jr., Elizabethtown, PA (US); Lynn Robert Sipe, Mifflintown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/930,485

(22) Filed: Aug. 31, 2004

(65) Prior Publication Data

US 2006/0046568 A1 Mar. 2, 2006

(51) Int. Cl.
*H01R 1/00* (2006.01)

(52) U.S. Cl. ..... 439/79; 439/924.1

(58) Field of Classification Search ..... 439/79, 439/108, 489, 608, 924.1
See application file for complete search history.

(56) References Cited

U.S. PATENT DOCUMENTS 6,540,522 B2 * 4/2003 Sipe ..... 439/61
6,592,381 B2 * 7/2003 Cohen et al. ..... 439/80
6,638,079 B1 * 10/2003 Billman et al. ..... 439/76.1
6,764,349 B2 * 7/2004 Provencher et al. ..... 439/701
6,786,761 B1 * 9/2004 Benavides ..... 439/490
6,808,399 B2 * 10/2004 Rothermel et al. ..... 439/108
6,811,440 B1 11/2004 Rothermel et al. ..... 439/608
6,870,271 B2 * 3/2005 Sutherland et al. ..... 257/777
6,875,031 B1 * 4/2005 Korsunsky et al. ..... 439/79
6,890,215 B2 * 5/2005 Lang et al. ..... 439/608
6,932,649 B1 * 8/2005 Rothermel et al. ..... 439/620

* cited by examiner

*Primary Examiner*—Thanh-Tam Le

(57) ABSTRACT

An electrical connector is provided that includes a dielectric housing having a plurality of slots therein, and a plurality of electrical contacts disposed within at least one of the slots. A plurality of electrical wafers, are each received in one of the plurality of slots. Each wafer has a first edge and a second edge. Some of the plurality of electrical wafers are signal wafers and some of the plurality of wafers are power wafers. Each of the power wafers includes at least one trace and at least one contact pad. The contact pad is sized to mate with a predetermined number of the plurality of contacts to transfer a predetermined amount of current through the trace.

12 Claims, 6 Drawing Sheets

ELECTRICAL CONNECTOR POWER WAFERS

BACKGROUND OF THE INVENTION

The invention relates generally to electrical connectors and, more particularly, to a signal level connector with power handling.

Modern electronic systems such as telecommunications systems and computer systems often include large circuit boards called backplane boards which are rack mounted or retained in cabinets and are electrically connected to a number of smaller circuit boards called daughter cards. Electrical connectors establish communications between the backplane and the daughter cards. The daughter cards are typically separate from each other and meet different requirements for different purposes such as transmission of high speed signals, low speed signals, power, etc. that are transferred to the daughter cards from the backplane board.

In today's systems, there is a continuously increasing demand for resources, such as signal and power, and as a result, connector space on the circuit boards is in short supply. In many instances, due to space limitations, system operators limit the amount of connector space available for each application. Generally, separate connectors are used for power and signal transmission. With separate signal connectors and power connectors, the connectors are, at times, larger than need be for the amount of the particular resource, i.e. the amount of power or the number of signal lines, needed by the daughter card. Alternatively, some applications may have requirements for a particular resource, such as power, for instance, in an amount that cannot be accommodated with the connectors readily available that can fit into the allotted space.

A need exists for a connector that is configurable to provide multiple types of resources such as signal and power transmission in the same connector. A further need exists for a connector that is configurable to meet particular resource requirements such as voltage, current, or separation space. It would also be advantageous if a given resource could be placed in a designated location within the connector.

BRIEF DESCRIPTION OF THE INVENTION

In one aspect, an electrical connector is provided. The connector includes a dielectric housing having a plurality of slots therein, and a plurality of electrical contacts disposed within at least one of the slots. A plurality of electrical wafers, are each received in one of the plurality of slots. Each wafer has a first edge and a second edge. Some of the plurality of electrical wafers are signal wafers and some of the plurality of wafers are power wafers. Each of the power wafers includes at least one trace and at least one contact pad. The contact pad is sized to mate with a predetermined number of the plurality of contacts to transfer a predetermined amount of current through the trace.

Optionally, each of the power wafers includes a predetermined number of traces to transfer a predetermined amount of current through the connector. Each wafer includes a first side and a second side and at least one of the power wafers includes traces on each of the first and second sides to increase a current carrying capacity of the connector. Some of the signal wafers are high speed signal wafers and some of the signal wafers are low speed signal wafers; and at least one of the plurality of wafers is a printed circuit board wafer.

In another aspect, an electrical connector is provided. The connector includes a dielectric housing having a plurality of slots therein, and a plurality of electrical contacts disposed within at least one of the slots. A plurality of electrical wafers are each received in one of the plurality of slots. Each wafer includes a mating edge and a plurality of contact pads arranged along the mating edge. At least one of the wafers is configured to suppress arcing at the contact pads when the wafer is separated from a mating connector.

In yet another aspect, an electrical connector is provided that includes a dielectric housing having a plurality of slots therein, and a plurality of electrical contacts disposed within at least one of the slots. A plurality of electrical wafers, are each received in one of the plurality of slots. Each wafer includes a mating edge and a plurality of contact pads arranged along the mating edge. At least one of the wafers is configured to induce arcing at a sacrificial contact in a mating connector when the at least one wafer is separated from the mating connector.

In a further aspect, an electrical connector is provided. The connector includes a dielectric housing having a plurality of slots therein, and a plurality of electrical contacts disposed within at least one of the slots. A plurality of electrical wafers are each received in one of the plurality of slots. At least one of the wafers is configured to carry and isolate a hazardous voltage.

In another aspect, an electrical connector system is provided. The connector system includes a backplane connector and a daughter card connector configured to mate with the backplane connector. The daughter card connector includes a dielectric housing having a plurality of slots therein, a plurality of electrical contacts disposed within at least one of the slots, and a plurality of electrical wafers, each received in one of the plurality of slots. The plurality of wafers are selectively arranged in the daughter card connector in one of a plurality of configurations of the daughter card connector. The backplane connector mates with the plurality of configurations of the daughter card connector without change to an interface between the backplane connector and the daughter card connector.

DETAILED DESCRIPTION OF THE INVENTION

Figure 1:
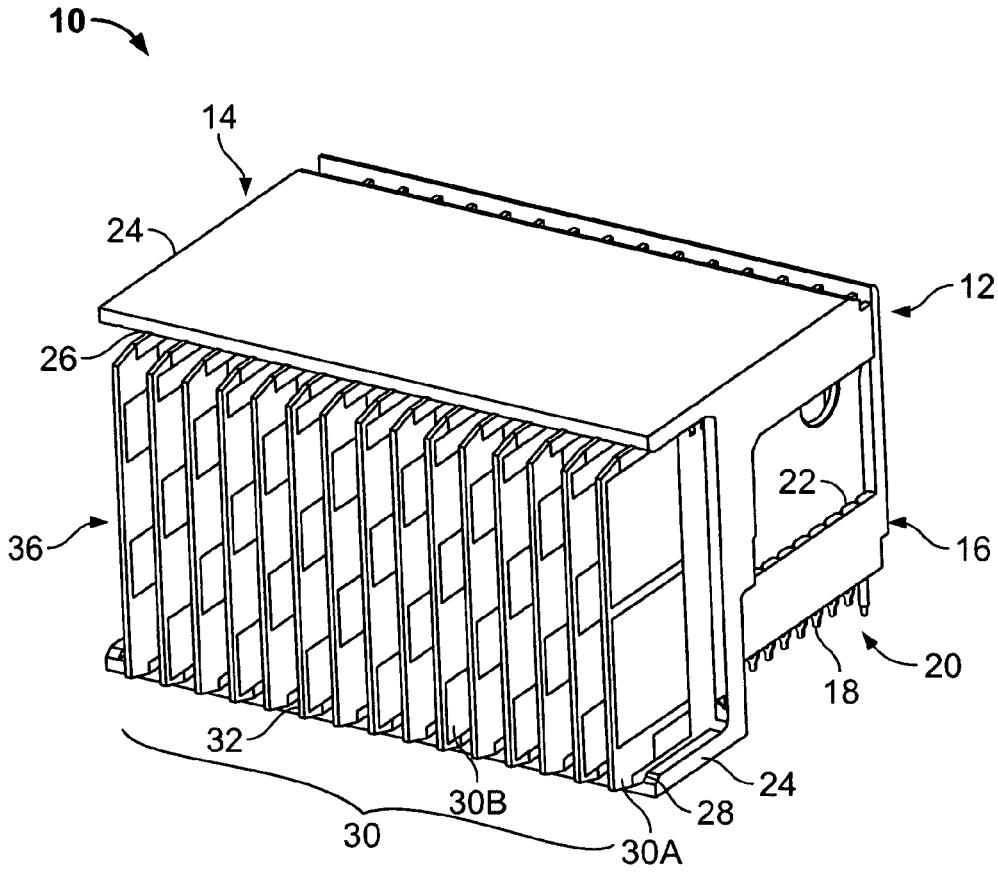
FIG. 1 is a perspective view of an electrical connector formed in accordance with an exemplary embodiment of the present invention.

FIG. 1 illustrates a perspective view of an electrical connector 10 formed in accordance with an exemplary embodiment of the present invention. While the invention will be described in terms of a right angle connector, it is to be understood that the benefits described herein are also applicable to connectors formed at other than a right angle. The following description is for illustrative purposes only and is but one potential application of the inventive concepts herein. In addition, the connector 10 will be described as including one or more electrical wafers. As used herein, the term wafer shall include an all metal conductive sheet in addition to the meanings commonly given the term in the art.

The connector 10 includes a housing 12 that has an upper portion 14 and a base portion 16. The base 16 includes a plurality of contacts 18 that form a daughter card interface 20 that is also a mounting face at the base 16 of the connector 10. The base 16 includes a plurality of slots 22. The contacts 18 include terminal ends (not shown) that extend upwardly through the base 16 and into the slots 22. The upper portion 14 also includes a shroud 24 that has a plurality of corresponding upper and lower slots 26 and 28 respectively formed therein. The upper and lower slots 26 and 28, respectively, are aligned with the slots 22 in the base 16. A plurality of electrical wafers 30 are received in the slots 22, 26, and 28. The wafers 30 are electrically connected to the contacts 18 in the slots 22. The upper and lower slots 26 and 28 cooperate to position and stabilize the wafers 30 in the housing 12. Each wafer 30 includes a mating edge 32 that extends through a mating face 36 of the connector 10. The mating face 36 of the connector 10 defines a backplane connector interface. In one embodiment, the connector 10 is used to interconnect a daughter board (not shown) with a backplane board (not shown) to transfer resources, such as signal and power, between the two circuit boards.

The connector 10 is a modular connector that can be customized to meet a user's particular requirements. The wafers 30 in the connector 10 are not necessarily all of the same type; and further, each can be functionally independent of the others. That is, the connector 10 can include a mix of electrical wafers 30 that perform different functions. The connector 10 can be customized to a particular need simply by loading the appropriate wafer 30 in a particular slot 22 in the connector 10. For instance, in an exemplary embodiment, the connector 10, as shown in FIG. 1, is configured to carry signal information on wafers 30B and also transfer power on wafer 30A. Further, in an alternative embodiment, the signal wafers 30B may include both high density signal wafers and low density signal wafers as well as wafers carrying high speed signals along with wafers carrying low speed signals. In addition, each signal wafer 30B may carry a different number of signal lines.

Figure 2:
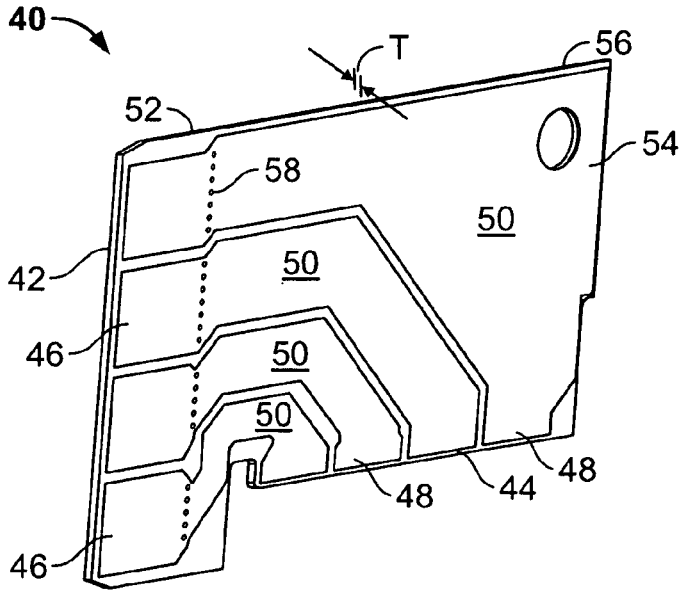
FIG. 2 is a perspective view of an exemplary electrical wafer according to one embodiment of the present invention.

FIG. 2 is a perspective view of an exemplary electrical wafer 40 according to one embodiment of the present invention. The wafer 40 includes a first edge 42 and a second edge 44. In an exemplary embodiment, the first edge 42 and second edge 44 are substantially at a right angle to each other. A plurality of contact pads 46 are distributed along the first edge 42 and are configured to mate with a mating connector (not shown). A plurality of contact pads 48 are also distributed along the second edge 44. The second edge 44 is received in one of the slots 22 (FIG. 1) in the housing base 16 so that the contact pads 48 are electrically and mechanically engaged with the contacts 18 (FIG. 1). The wafer 40 includes a plurality of electrical traces 50 that interconnect the first edge contact pads 46 with the second edge contact pads 48. In an exemplary embodiment, the wafer 40 is a printed circuit board wafer that has a dielectric substrate 52 upon which the traces 50 and contact pads 46 and 48 are placed. The wafer 40 has a first side 54 and a second side 56 opposite the first side 54.

In one embodiment, the wafer 40 is a power wafer. When configured for power transmission, each of the traces 50 on the wafer 40 can carry either the same amount of current or different amounts of current. The current carrying capacity of each trace 50 can be tailored by varying the size and/or thickness T of the trace 50. In an exemplary embodiment, the wafer 40 is formed with each of the traces 50 having a predetermined thickness T to carry a predetermined amount of current through each of the traces 50. The current carrying capacity can also be enhanced by placing traces 50 on both sides 54 and 56 of the wafer 40. Vias 58 extend through the wafer 40 to interconnect the first and second sides 54 and 56 respectively. The amount of current carried through each trace 50 can also be influenced by the number of contacts 18 in the housing base 16 (FIG. 1) that engage the contact pads 48 and the number of contacts in the mating connector that engage the contact pads 46. The contact pads 46 and 48 can be sized so as to span a predetermined number of contacts, such as the contacts 18, to distribute the current over the predetermined number of contacts 18. These factors, of course, are considered in the design of the daughter board and backplane board that are being interconnected.

The aforementioned customizations in the connector 10 are easily achieved by replacing one or more of the wafers 40 with wafers having the desired features. The wafers 40 can be easily obtained by making an artwork change on the wafer 40 during production. That is, the variations are obtainable by changing the wafer design which does not require changes to the design of the connector 10.

Figure 3:
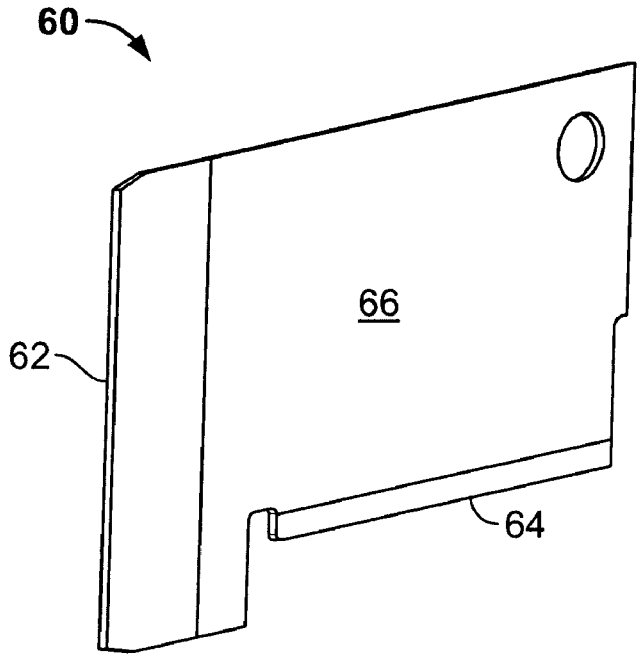
FIG. 3 is a perspective view of a power wafer according to an alternative embodiment of the present invention.

FIG. 3 is a perspective view of an alternative embodiment of a power wafer 60 that may be used in the connector 10 (FIG. 1). The wafer 60 includes a first edge 62 and a second edge 64. The wafer 60 is formed from a solid metal sheet 66. The wafer 60 is suitable for use in applications that require a high current carrying capacity. Current is distributed over the number of mating contacts, such as the contacts 18 (FIG. 1) along the daughter card interface 20 and the contacts (not shown) distributed along the mating edge in the backplane connector that receives the first edge 62.

Figure 4:
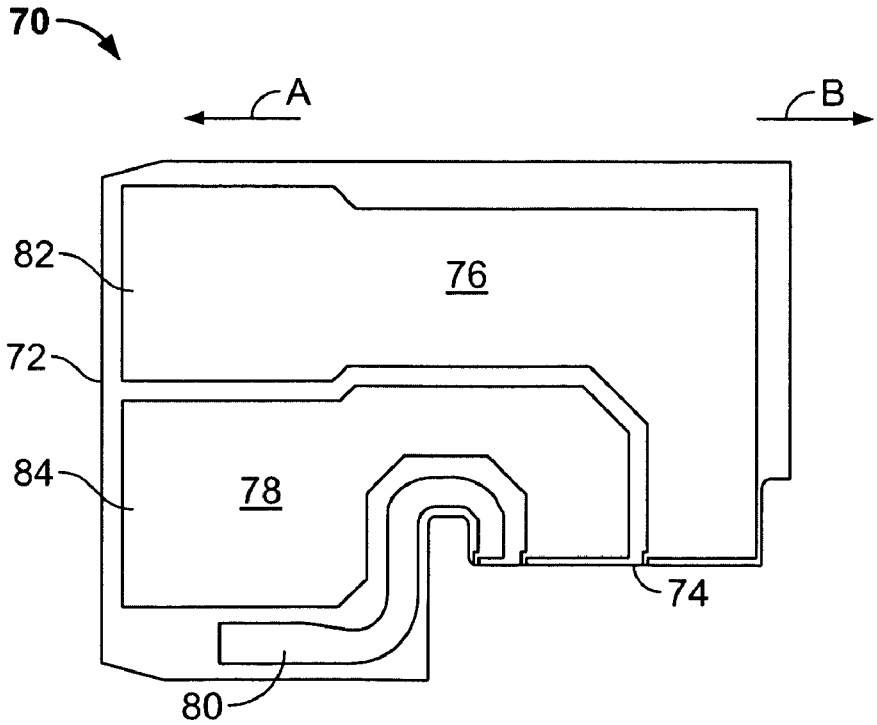
FIG. 4 is a top plan view of a power wafer according to second alternative embodiment of the present invention.

FIG. 4 illustrates a top plan view of a power wafer 70 formed in accordance with an alternative embodiment of the present invention. The wafer 70 is suitable for use in the connector 10 and includes a first edge 72, a second edge 74, a first power trace 76, a second power trace 78, and a trace sense line 80. The power traces 76 and 78 have contact pads 82 and 84, respectively along the first edge 72. The sense line trace gives an indication of the condition, or alternatively, the mating position of the connector 10. The sense line trace 80 is connected to a sense line circuit or a control circuit (not shown) that is configured to give a notification to the daughter board and backplane circuits or systems that the power to the circuits is about to be turned on or turned off by mating or unmating of the connector 10. As shown in FIG. 4, the first edge 72 is a mating edge of the wafer 70. The wafer 70 is mated by moving the wafer 70, or more specifically, by moving the connector 10 containing the wafer 70 in the direction of the arrow A. Unmating occurs in the direction of the arrow B. In FIG. 4, the sense line trace 80 on the wafer 70 is configured to mate last and break first such that the sense line circuit can give an indication that the connector 10 is about to be unmated and consequently, power is about to be interrupted. When the sense line trace 80 breaks, the sense line circuit notifies the systems to shut down so that arcing does not occur at the contact pads 82 and 84. In an alternative embodiment, the sense line trace 80 can be positioned on the wafer 70 in a mate first, break last configuration so that a system or circuit could be notified of a power turn on.

Figure 5:
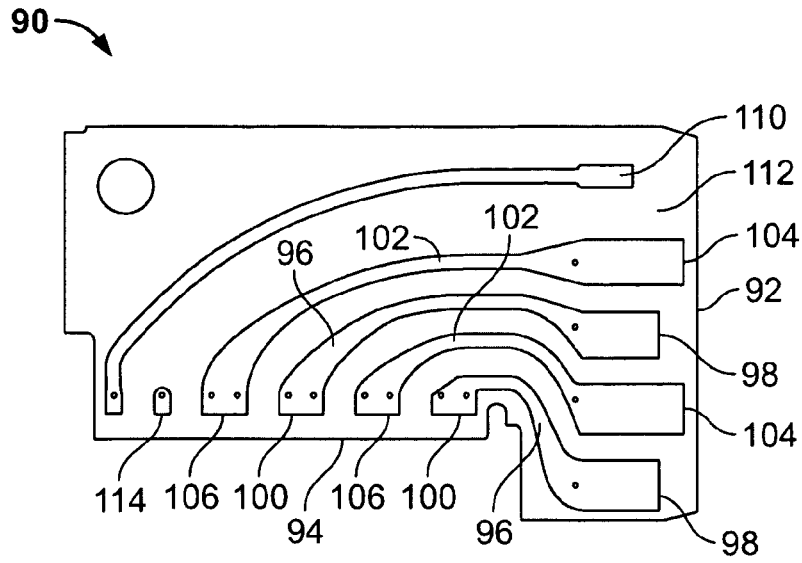
FIG. 5 is a top plan view of an electrical wafer including an isolation space according to an alternative embodiment of the present invention.

FIG. 5 illustrates a top plan view of an electrical wafer 90 that is suitable for use in the connector 10. The wafer 90 includes a first edge 92 and a second edge 94. In one embodiment, the wafer 90 is a forty eight volt power wafer that includes V-plus traces 96 that interconnect V-plus contact pads 98 along the first edge 92 and V-plus pads 100 along the second edge 94. Ground traces 102 interconnect ground contact pads 104 along the first edge 92 and ground contact pads 106 along the second edge 94. The wafer 90 also includes a sense line trace 110 that is separated from the other traces by an isolation space 112.

The telecommunications industry, for example, has a forty-eight volt power standard along with a requirement that the forty-eight volt power line be isolated by a specified amount of space from anything else that is conductive. The isolation is typically provided by an air gap around the power line. In FIG. 5, the wafer 90 includes a forty-eight volt power line and the requirement for isolation is achieved by leaving a trace off of the wafer 90, as indicated by the unused contact pad 114. The isolation space 112 can be located anywhere on the wafer 90 through the wafer artwork when the wafer 90 is fabricated.

Figure 6:
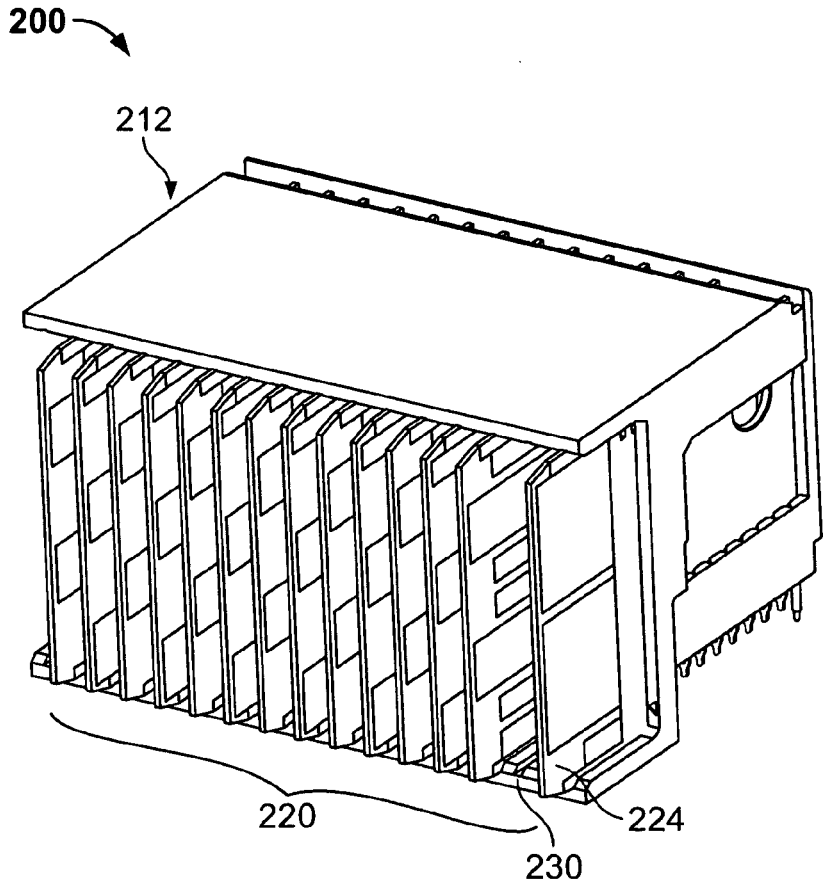
FIG. 6 is a perspective of a connector formed in accordance with an alternative embodiment of the present invention.

FIG. 6 is a perspective view of a connector 200 formed in accordance with an alternative embodiment of the present invention. The connector 200 illustrates a second application of isolation space. The connector 200 includes a housing 212 that contains a plurality of electrical wafers 220 including a power wafer 224. In the connector 200, a slot 230 has been left unpopulated to provide an isolation space for the wafer 224. In other embodiments of the connector 200, the power wafer 224 and the unpopulated slot could be located at any two adjacent positions in the housing 212.

Figure 7:
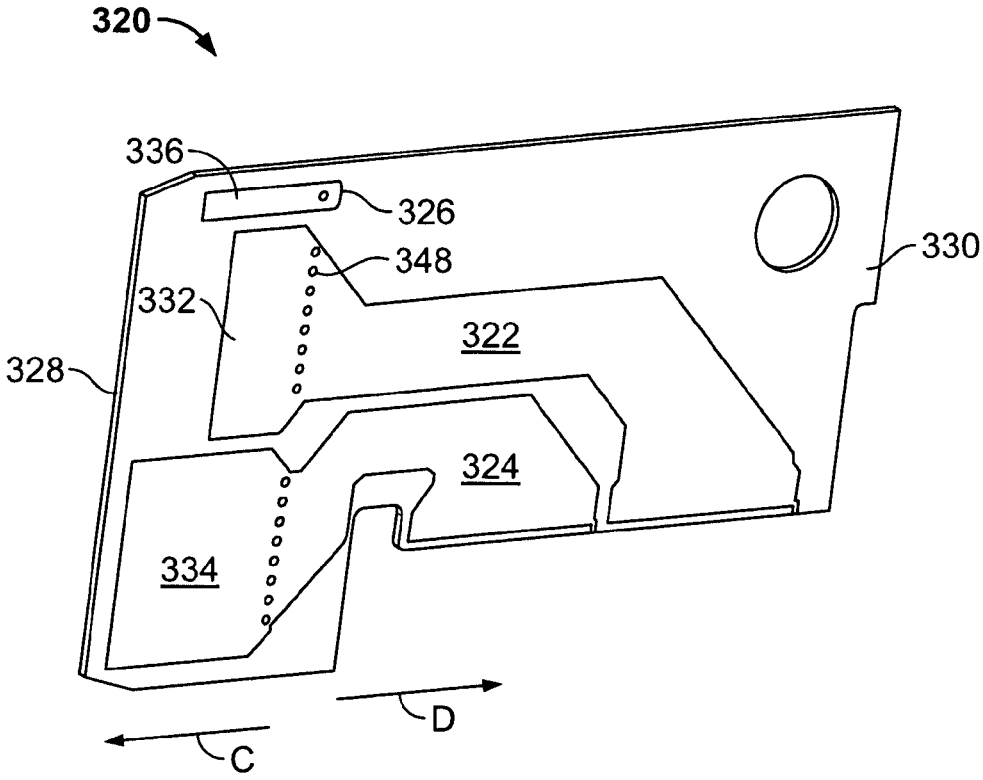
FIG. 7 is a perspective view of a power wafer according to a third alternative embodiment of the present invention.

FIG. 7 illustrates a perspective front view of a wafer 320 that is suitable for use in the connector 10 or the connector 200. The wafer 320 is a power wafer that includes a V-plus trace 322, a ground trace 324 and a sense line trace 326. The wafer 320 has a mating edge 328 and mates in the direction of the arrow C and unmates in the direction of the arrow D. The traces 322, 324, and 326 on a front side 330 of the wafer 320 include contact pads 332, 334, and 336, respectively, that are staggered with respect to the wafer mating edge 328 so that the traces 322, 324, and 326 can sequentially disconnect to prevent arcing when the wafer 320 is moved in the direction of the arrow D from a mated to an unmated condition as will be described.

Figure 8:
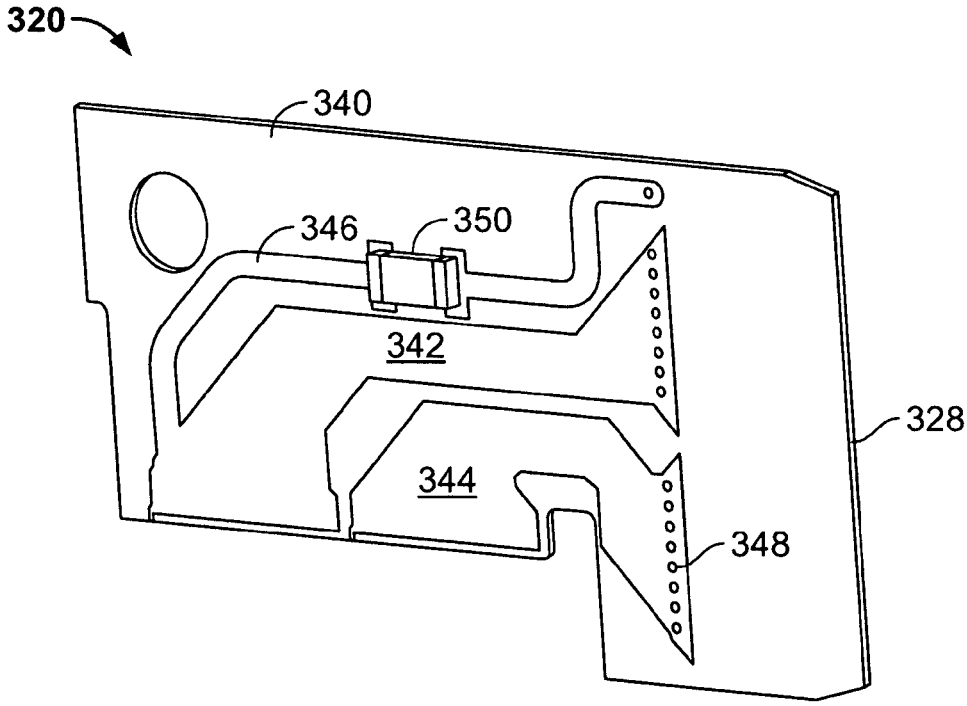
FIG. 8 is a perspective view of the rear side of the wafer shown in FIG. 7.

FIG. 8 illustrates a perspective view of a rear side 340 of the wafer 320 shown in FIG. 7. The rear side includes a V-plus trace 342, a ground trace 344 and a sense line trace 346 that are connected by vias 348 to the front side traces 322, 324, and 326 respectively. The sense line trace 346 joins the V-plus trace 342 and is therefore common with the V-plus trace 342. The sense line trace 346 includes an active switching member 350 that is configured to shut down the power carried on the wafer 320 before arcing can occur at the V-plus contact pad 332 if the connector is unmated when the power is on. In the exemplary embodiment, the active switching member 350 is surface mounted to the wafer 320. In one embodiment, the active switching member 350 is a PolySwitch™ commercially available from Tyco Electronics Corporation of Middletown, Pa.

The operation of the active switching member to prevent arcing will be described with reference to FIGS. 9, 10, and 11.

Figure 9:
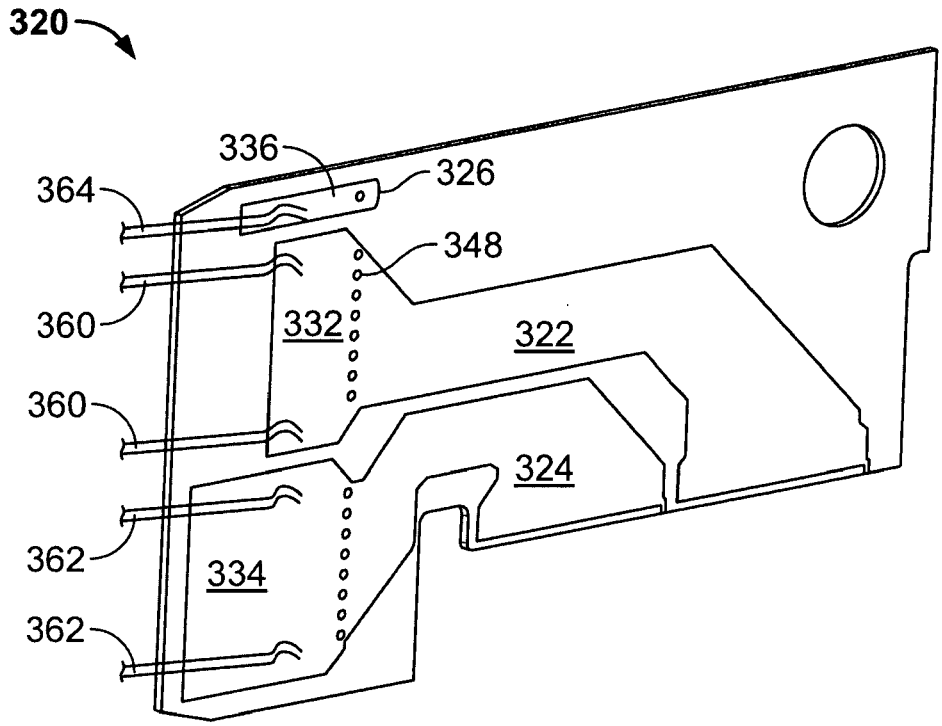
FIG. 9 is a perspective view of the wafer shown in FIGS. 7 and 8 in a fully mated position.

FIG. 9 illustrates the wafer 320 in a fully mated with a mating connector (not shown). When fully mated, V-plus mating contacts 360, ground mating contacts 362, and sense line mating contact 364, are all engaging respective pads 332, 334, and 336.

Figure 10:
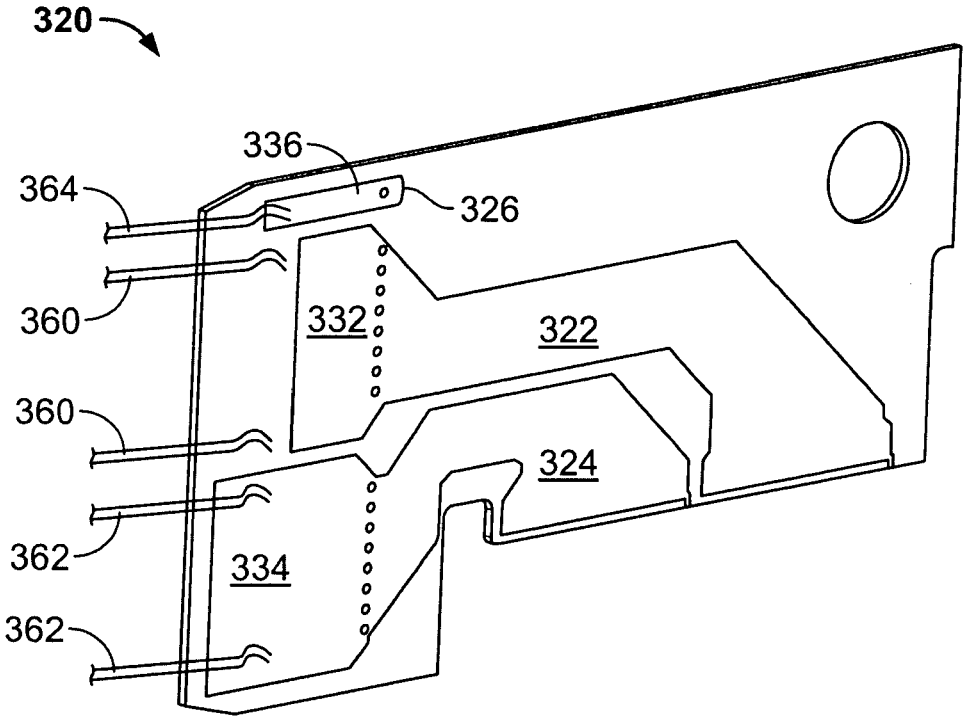
FIG. 10 is a perspective view of the wafer shown in FIGS. 7 and 8 in a partially mated position.

FIG. 10 illustrates the wafer 320 in a partially unmated condition. In FIG. 10, the V-plus trace 322 is unmated; but, the sense line trace 326 and the ground trace 324 are still connected. More specifically, the current carried by the V-plus trace 322 shifts to the sense line trace 326 and the active switch member 350 (FIG. 8). Since current flow has not been interrupted, there is no arcing at the V-plus contact pad 332. The switch member 350 is configured to react to the increased current flow therethrough and shut down the current flow through the wafer 320.

Figure 11:
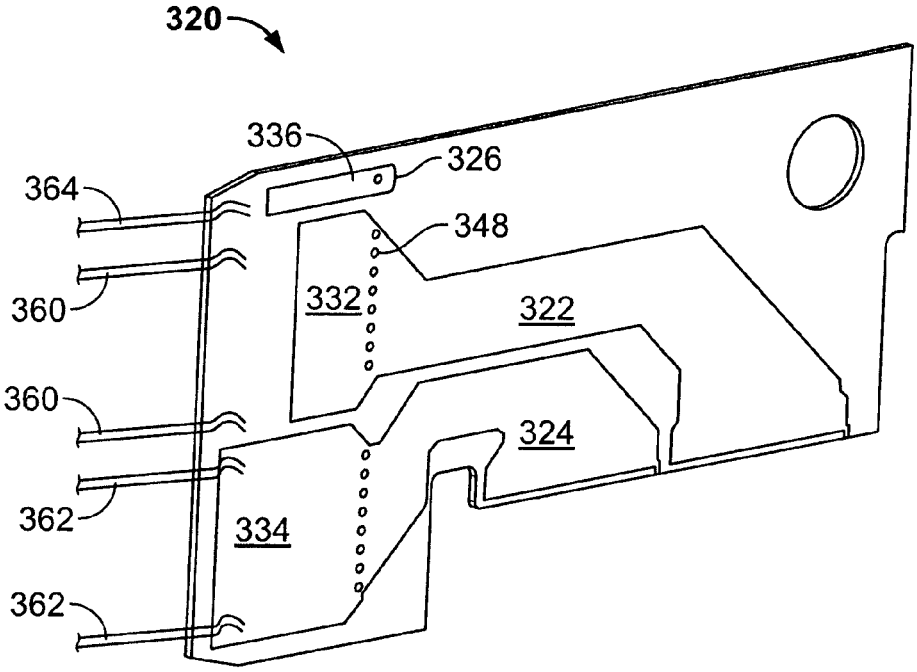
FIG. 11 is a perspective view of the wafer shown in FIGS. 7 and 8 prior to being moved to a fully unmated position.

FIG. 11 illustrates the wafer 320 with both the sense line trace 326 and the V-plus trace 322 unmated. At this stage, current flow has been shut down and only the ground trace 324 is connected. Since the current flow has been shut down, the connector 10 can be fully unmated without arcing at any contact pad 332, 334, and 336. Thus, with the wafer 320, power to a circuit can be turned off safely simply by unmating the connector 10.

Figure 12:
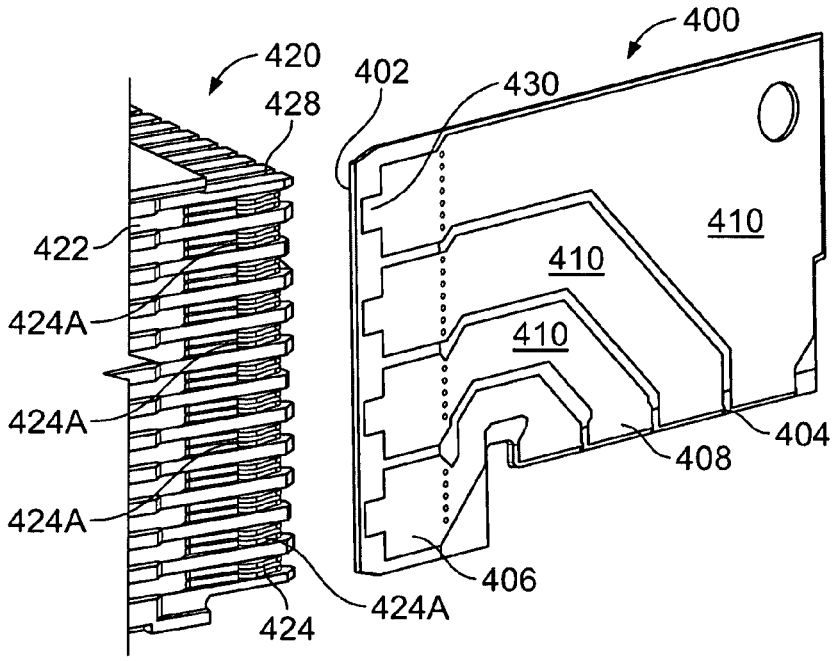
FIG. 12 is a perspective view of an exemplary electrical wafer according to an alternative embodiment of the present invention.

FIG. 12 illustrates a perspective view of an alternative electrical wafer 400 that is suitable for use in the connector 10, 200. The wafer 400 illustrates another alternative wafer design to control arcing when the connector 10 is being mated or unmated with power applied through the connector 10. The wafer 400 includes a first edge 402 and a second edge 404. A plurality of contact pads 406 extend along the first edge 402 and a plurality of contact pads 408 extend along the second edge 404. Conductive traces 410 interconnect respective contact pads 406 and 408. In one embodiment the wafer 400 is a power wafer.

The first edge 402 is a mating edge that is received in a mating backplane connector 420 shown partially in FIG. 12. The backplane connector 420 includes a housing 422 that holds a plurality of contacts 424 positioned in a plurality of slots 428. The contacts 424 are arranged to mate with the contact pads 406 at the mating edge 402 of the wafer 400. Multiple contacts 424 in the backplane connector 420 mate with each contact pad 406 on the wafer 400 providing a redundancy in the connection. In one embodiment, three of the contacts 424 mate with each contact pad 406. The contact pads 406 each includes a projection 430 that is the last portion of the contact pad 406 to break contact with certain ones of the backplane connector contacts 424A when the wafer 400 is separated from the backplane connector. The contacts 424A are designated as sacrificial contacts. That is, arcing is restricted to occur at the designated sacrificial contacts 424A. The remaining contacts 424 are preserved and do not experience arcing or burning when the wafer 400 is separated from the backplane connector 420.

The connector 10, 200 and the backplane connector 420 form an electrical connector system wherein a single backplane connector design, such as in the backplane connector 420, can be used with multiple configurations of a daughter card connector, such as the connector 10 or the connector 200, whose configuration is determined by the arrangement and type of electrical wafers loaded in the daughter card connector 10, 200. That is, the backplane connector 420 and the daughter card connector 10, 200 form a connector system that can be modified solely by changing the daughter card connector side, e.g. the connector 10, 200, of the mating pair. The daughter card connector 10, 200 may include, without limitation, any combination of wafers including the particular wafer embodiments herein described.

The embodiments thus described provide a modular connector that can be used to transfer resources, such as signal and power, between backplane boards and daughter boards. The connector includes a plurality of electrical wafers that can be customized to provide a variety of features and may include transmission of both signal and power in the same connector. The characteristics of the connector can be changed by changing only the wafer design. Further, wafers can be selectively loaded or not loaded in the connector to match application requirements. The variations in the modular connector require no modifications in the backplane connector.

While the invention has been described in terms of various specific embodiments, those skilled in the art will recognize that the invention can be practiced with modification within the spirit and scope of the claims.

What is claimed is:

1. An electrical connector comprising;

a dielectric housing having a plurality of slots therein, and a plurality of contacts disposed within of said slots;

a plurality of electrical wafers, each of said electrical wafers being received in one of said plurality of slots, each said wafer having a first edge and a second edge, some of said plurality of electrical wafers being signal wafers and some of said plurality of wafers being power wafers, each of said power wafers including first and second power contact pads located at said first and second edges, respectively, said power wafer including a power trace extending between said first and second power contact pads, said second power contact pad mating with at least two of said plurality of contacts to transfer a predetermined amount of current through said power trace between said first and second power contact pads; and a sense line trace on at least one of said power wafers, said sense line trace configured to unmate first when the connector is being unmated to indicate a condition of the connector.

2. The connector of claim 1, wherein said first and second edges are formed at right angles to one another.

3. The connector of claim 1, wherein each of said first power contact pads engages at least two power contacts in a mating connector.

4. The connector of claim 1, further comprising a plurality of electrically separate power contact pads located at said first edge, an equal plurality of electrically separate power contact pads located at said second edge and an equal plurality of electrically separate power traces interconnecting separate corresponding said power contact pads at said first and second edges.

5. An electrical connector comprising;

a dielectric housing having a plurality of slots therein; and a plurality of electrical wafers, each of said electrical wafers being received in one of said plurality of slots, each said wafer including first and second edges and a plurality of contact pads arranged along said first and second edges, at least one of said wafers being configured to suppress arcing at said contact pads when said at least one wafer is separated from a mating connector, wherein at least one of said plurality of wafers includes power contact pads located at said first and second edges, a power trace extending between said power contact pads, and a sense line trace, said sense line trace being positioned on said wafer to unmate before said power contact pads unmate to generate a disconnect signal deliverable to a control circuit when the connector is being unmated.

6. The connector of claim 5, wherein said sense line trace includes an active circuit device mounted on said wafer, said active circuit device configured to switch power carried on said wafer before the connector is fully unmated.

7. The connector of claim 5, wherein at least one of said wafers includes a sense line trace, a power line trace, and a ground trace, said sense line, power, and ground traces each joining to corresponding contact pads arranged along said first and second edges so that said sense line, power, and ground traces sequentially disconnect from a mating connector when said wafer is unmated from the mating connector.

8. The connector of claim 5, wherein each of said plurality of electrical wafers comprises a printed circuit board wafer.

9. The connector of claim 5, wherein said first and second edges are formed at right angles to one another.

10. The connector of claim 5, further comprising a plurality of contacts disposed within said slots, wherein at least two of said contacts both engage a single one of said second contact pads.

11. The connector of claim 5, wherein each of said first power contact pads engages at least two power contacts in a mating connector.

12. The connector of claim 5, further comprising a plurality of electrically separate power contact pads located at said first edge, an equal plurality of electrically separate power contact pads located at said second edge and an equal plurality of electrically separate power traces interconnecting separate corresponding said power contact pads at said first and second edges.

* * * * *